United States Patent [19]

Derdzinski et al.

[11] 4,113,331

[45] Sep. 12, 1978

[54] MODULAR CONSOLE ENCLOSURE WITH WRITING SURFACE

[75] Inventors: Terrence Edmund Derdzinski, Addision, Ill.; James Hilliard Karlin, Fairport, N.Y.

[73] Assignee: Motorola, Inc., Schaumburg, Ill.

[21] Appl. No.: 620,987

[22] Filed: Oct. 9, 1975

[51] Int. Cl.[2] ..... A47B 27/00; A47B 53/00

[52] U.S. Cl. ..... 312/198; 312/231; 312/257 SM; 312/281; 211/134

[58] Field of Search ..... 108/149, 150, 151, 147, 108/148; 312/231, 257, 263, 264, 277, 280, 281; 248/248; 111/134

[56] References Cited

U.S. PATENT DOCUMENTS

| | | | |
|---|---|---|---|
| 928,614 | 7/1909 | Mohr | 312/231 X |
| 1,109,734 | 9/1914 | Bauer | 312/282 UX |
| 1,528,268 | 3/1925 | Schlegel | 248/247 |
| 2,643,170 | 6/1953 | Vanderveld et al. | 211/193 |
| 2,855,261 | 10/1958 | Wells et al. | 312/281 X |
| 2,912,294 | 11/1959 | Wells et al. | 312/257 A |
| 2,960,238 | 11/1960 | Park | 211/134 |
| 3,028,211 | 4/1962 | Wells et al. | 312/281 X |
| 3,034,844 | 5/1962 | Anderson et al. | 312/281 X |
| 3,041,033 | 6/1962 | Schwartz | 248/248 |
| 3,148,857 | 9/1964 | Hutchison | 248/247 |
| 3,164,255 | 1/1965 | Fay | 211/193 |
| 3,178,246 | 4/1965 | Riles | 312/257 SK |
| 3,189,394 | 6/1965 | Fay | 312/281 X |
| 3,837,720 | 9/1974 | Boris et al. | 312/198 |

OTHER PUBLICATIONS

"EMCOR Modular Enclosure System": Bulletin 102-CA1OM-154 Elgin Metalformers Corp., Elgin, Illinois; copyright 02-26-1954, USA.

*Primary Examiner*—Mervin Stein
*Assistant Examiner*—Victor N. Sakran
*Attorney, Agent, or Firm*—Margaret Marsh Parker; James W. Gillman

[57] ABSTRACT

A modular console system for housing display devices, panel-mounted apparatus, storage facilities, writing surfaces and the like comprises interchangeable parts which can be assembled or replaced on site. The writing surfaces are added or removed from the front and are cantilevered from a V-shaped structural member without occupying otherwise useful space.

3 Claims, 4 Drawing Figures

Fig. 2
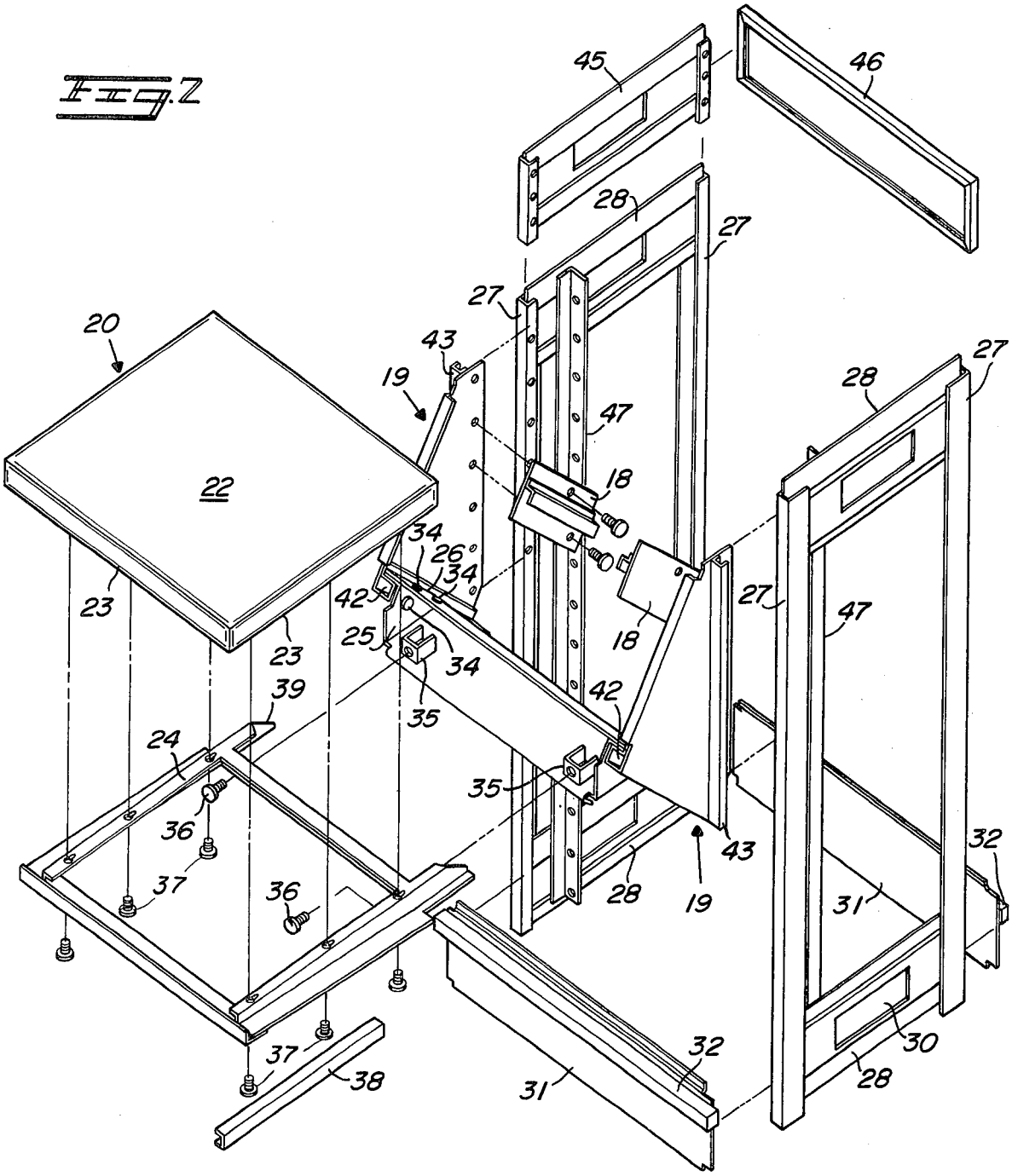
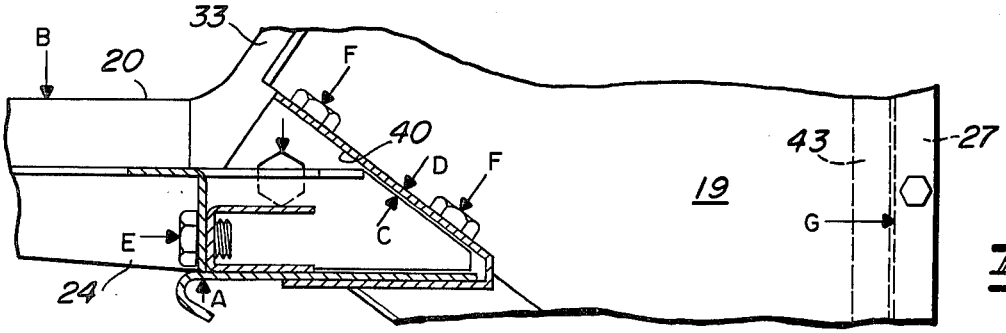
Fig. 4

MODULAR CONSOLE ENCLOSURE WITH WRITING SURFACE

BACKGROUND OF THE INVENTION

This invention relates to the field of modular console systems and, in particular, to modules having very stong, attachable writing surfaces.

In the field of modular console type housing for apparatus such as communications equipment, there are two broad classes of design philosophy: a first class having a strong framework, usually welded together, covered with a thin skin of cover panels. A second class, completely made up of formed, sheet metal parts, is used for bearing light loads and is normally shipped completely assembled because of the difficulty of shipping parts without damage. In the first class, the load-carrying capability is inherently greater than that of the second class, and is generally limited only by the number and thickness of the structural members.

When it comes to attaching a writing surface to either style, two approaches have developed. The first approach is to make the writing surface strictly an "add-on", with all support for the surface out in front of the basic support structure, which makes it difficult to provide great strength for the writing surface support. The second approach is to mount the writing surface on brackets which are supported inside the enclosure, requiring essentially the same structure as is required for mounting a chassis on the interior, for example. This type of mounting provides greater strength but obviously interferes with mounting other equipment in the same space. This interference is magnified in a console where equipment is mounted above the writing surface and at an oblique angle to it. A need has existed, therefore, for a writing surface mounting for a console type enclosure which is extremely strong, yet preempts no otherwise useful space within the enclosure. Also highly desirable are a writing surface which can be inserted or removed as desired "on-site", and a modular enclosure design with the various units having many common components and being appropriately sturdy and stable.

SUMMARY OF THE INVENTION

It is, therefore, an object of this invention to provide a modular enclosure system of sturdy and stable design, having an extremely strong and rigid writing surface which can easily be added to or taken out of a console on-site.

It is a more specific object to provide a mounting for such a writing surface within otherwise unused space in the enclosure.

It is another object of the invention to provide the above within a system of modules having many common structural and panel members.

According to the invention the several different modular components of the system utilize many common structural and panel members. Since these modules do not depend for strength on the cabinet "skin" or cover panels primarily, they can be bolted together in a wide variety of configurations with only the exposed surfaces covered by panels. This makes possible interconnection or interwiring which would otherwise be difficult or unsightly. It is also possible to combine low profile and high profile consoles, equipment storage units, 45° consoles, desk stands and table stands for a unified appearance.

In particular, where a strong writing surface is desired as a part of a console unit, the surface can be mounted as the unit is first assembled or easily added to an existing console by removing only a small front panel. There is no need to remove or interfere in any way with equipment within the enclosure. A slanted panel and surrounding bezel are mounted on a strong, wedge-shaped structural portion of the console. A V-shaped structural member or channel, also of heavy steel, mounts across the outermost points of the wedge-shaped portion and supports the desk surface brackets. The inner ends of the brackets are shaped to mate with the V-shaped member to provide cantilevered support for the writing surface, without subtracting from available equipment space.

BRIEF DESCRIPTION OF THE DRAWINGS

FIG. 2 is an exploded view of the structural members of a low profile console enclosure.

FIG. 4 is a simplified version of FIG. 3 with superimposed arrows indicating forces.

DESCRIPTION OF A PREFERRED EMBODIMENT

Figure 1:
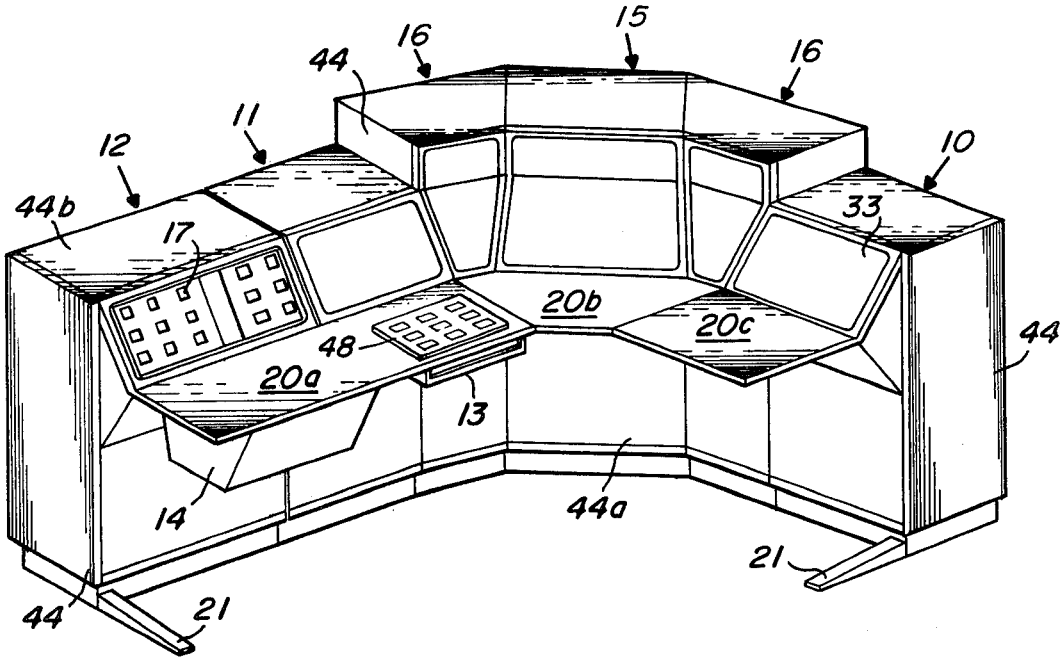
FIG. 1 is a perspective view of one possible grouping of modular enclosures.

The invention will be best understood by first referring to the drawing wherein FIG. 1 is a perspective view of one of many possible configurations of modular enclosures using the invention. It includes a typical basic or "low-profile" console enclosure 10, two low-profile enclosures 11, 12 with accessories 13, 14 added, a modified or "high-profile" enclosure 15, and two 45° high-profile enclosures 16.

Enclosure 12 has a control panel 17 mounted at an angle in the console by means of heavy brackets 18 mounted on the inner sides of two wedge-shaped structural members 19 (FIG. 2). This angled mounting has a double advantage in that one or more pieces of apparatus having a total front-to-back dimension greater than the depth of the enclosure can be accommodated and displayed at a desirable angle of presentation to the operator. For example, in the preferred embodiment, the angle is 36° from the vertical and the total depth available is 19.5 inches compared to 15.5 inches depth in the rest of the cabinet. Such apparatus could be visual display panels, control panels, etc. The wedge-shaped members 19 (shown in FIGS. 2 and 3) also support the weight of a writing surface 20 (the details of this construction will be described more fully in connection with FIG. 3). The writing surfaces 20 may extend across several enclosures with an unbroken surface, as do 20*a* and 20*b*, and may also have cut-outs (not shown) for mounting apparatus such as keyboards, switch panels, etc.

The low-profile and high-profile enclosures are designed to complement and combine with regular hexahedral enclosures (not shown) having the same height as either of the two console enclosures 10, 15 or with desk-height units (not shown) all having the same basic constructional details and having many common structural components. Extension feet 21 may be installed on either front or rear as needed for extra stability. The support structure of each enclosure is also adapted to being bolted to the floor if fixed mounting of the unit is desired.

In FIG. 2, the exploded view of the framework of a low-profile console enclosure is shown. The writing surface 20 is comprised of a top surface 22 and three side rails 23 of a strong rigid material, the preferred material being 47-lb density particle board. The outer surfaces are covered with a suitable desk top material such as high pressure melamine laminate. The underside of the writing surface is covered with a vapor barrier such as a melamine backing sheet. The writing surface 20 is supported by a support frame 24 formed of #11 gauge steel, the inner ends of which mate with a V-shaped bracket 25. A double thickness flange 26 is formed at each end of bracket 25. The V-shaped bracket is formed of #12 gauge steel (0.109 inches, 0.278 centimeters) mounted at the outermost points of the two wedge-shaped structural members 19 which also serve as side cover panels for the console projection of the module 10. The structural members 19 may be of #13 gauge steel (0.09 inches, 0.23 centimeters).

Figure 3:
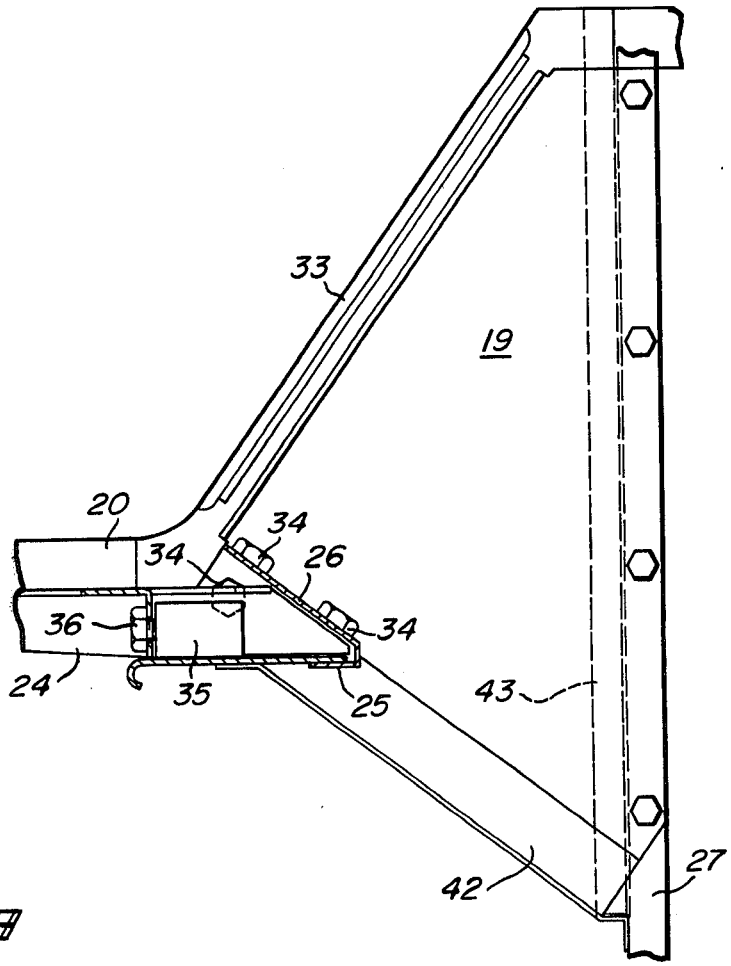
FIG. 3 is a partially cut away and enlarged side view of a portion of the console of FIG. 2 showing details of the writing surface support.

The framework of the module 10 also includes four vertical support members 27 and four horizontal bracing members 28 which in this embodiment are welded to the ends of the vertical members 27, though this is not essential to the invention. In each of the horizontal bracing members 28 there is a cable access aperture 30 which is left covered if not needed. There are two more horizontal bracing members 31 which connect the bottom ends of the vertical members 27 in the front and rear of the module. A horizontal channel 32 on each of the horizontal bracing members 31 serves a dual purpose as additional bracing and as decorative trim for the front and rear of the module. The vertical edges of the wedge-shaped members 19 are bolted to inner surfaces of the two front vertical support members 27. The bezel 33 (shown in FIG. 1) is mounted on the wedge-shaped members 19 of the low-profile console and, on the high-profile console, the bezel extends up onto the vertical support members 27. The V-shaped bracket 25 mounts across the outermost points of the wedge-shaped members 19 by means of six bolts 34 (three shown). The bracket 25 also includes integrally two small but very strong retaining brackets 35 each of which includes a threaded aperture in its vertical portion. The inner ends of the support frame 24 have a triangular shape to mate with the V-shaped bracket 25, and provide the cantilevered support for the writing surface 20. The support frame 24 is retained in the bracket 25 by the retaining brackets 35 and two bolts 36. FIG. 3 shows more detail of this mounting feature. FIG. 4 which illustrates the forces involved will be discussed more fully hereinbelow. A plurality of threaded bushings (not shown) are provided in the underside of the writing surface for receiving a like number of attaching screws 37. After the screws have been inserted about half way into the bushings, the writing surface is placed in position on the support frame 24 and the screw heads engaged with key hole slots in the frame. The writing surface is then pushed forward to contact the enclosure front and the screws tightened. Guide rails 38 may be mounted on the underside of the writing surface 20 to support accessories 13, 14.

FIG. 3 is an enlarged view of the mounting structure described above and shows more clearly how the support frame 24 mates with the V-shaped bracket 25 and is retained within the bracket 25 using only otherwise wasted space in the enclosure. As shown in FIG. 4, the fulcrum of the forces thus becomes the point A and any force B, pressing down on the writing surface 20, causes slanted end 39 of the frame 24 to bear directly (force C) on an angled surface 40 of the V-shaped bracket 25. Force C is counteracted by force D exerted by the surface 40. The forces E at the bolts 36 are at a minimum since they primarily maintain the frame 24 in contact with V-shaped member 25. Likewise, the forces F on the bolts 34 are not large since the downward force exerted on the wedge-shaped members 19 by the double thickness flanges 26 of the V-shaped bracket 25 is borne by a reinforcing channel 42 (FIG. 2) integral with each member 19. A second integral reinforcing channel 43 on each member 19 (as force G) butts up against the vertical members 27 for added support of the projecting console portion.

The writing surface 20 and its support frame 24, which can hold a load of more than 600 pounds, are thus in turn supported by the main structural members of the enclosure without interfering with the mounting of any other part. The writing surface and its frame can be removed at any time by merely removing the two bolts 36. A small panel (not shown) is then fastened to the enclosure to cover the exposed V-shaped bracket 25. Likewise, the writing surface could be added "on-site" as easily.

Various panels 44 which cover the remaining visible portions of the modular enclosures 10, 11, 12, 15 and 16 are fabricated as to design and strength of material to serve also as structural members. In addition, the large front and rear panels 44A are door panels for easy access to the interior of the units and each has a lockable latch.

Accessories 13, 14, which can easily be added by installing the simple available rails 38 on the underside of the writing surface, include such items as pencil trays and file drawers.

Any one of the modular enclosures can be modified as to height by removing its top cover panel **44*b* attaching a standard frame extension part 45 to the vertical support members 27 on each side attaching a door panel extension 46** in back, and inserting additional equipment as desired. The top cover panel is then replaced.

Extra pieces of equipment such as connector panels for mounting banks of printed circuit boards (not shown) may be mounted within the enclosures on mounting rails 47 which are supported by the structural members 28 and located intermediate the front and rear of the enclosure.

As previously referred to, the writing surfaces 20 may have cut-out portions for installation of equipment such as keyboards 48. If desirable, wiring for such equipment can be brought from the underside of the writing surface into the interior of the enclosure by way of the slanted channels 42 on the inner surfaces of the wedge-shaped members 19, entering by the open upper end of the channels and exiting into the enclosure at the lower end of the channels.

What has been described is an improved mounting for a projecting member such as a writing surface within an enclosure. Accordingly, it will be understood that variations and modifications of this invention may be effected without departing from the spirit and scope of the concepts disclosed and claimed herein.

We claim:

1. A modular enclosure for housing apparatus and providing desk-type capability, the enclosure comprising:

vertical support members;

horizontal bracing members for attaching to the vertical support members;

panel members adapted for being exteriorly attached to the vertical members;

a V-shaped channel member having a first inward horizontal surface and another inward surface forming an acute angle with the first surface;

integral retaining brackets fixedly attached to one of the inward surfaces of the V-shaped channel member, each bracket having a threaded aperture therein;

two wedge-shaped panel members each having a vertical edge and a structural member formed adjacent the vertical edge for mounting each panel member on one of said vertical support members, the panel members being adapted to support the V-shaped member in horizontal positioning between the outermost portions of the wedge-shaped members;

a rigid writing surface having a width equivalent to at least one module width;

frame means for supporting the writing surface, the inward ends of the frame means adapted to mate with the inward surfaces of said acute angle of the V-shaped member, frame means having apertures therein and positioned for being aligned with the apertures in the retaining brackets; and fastener means adapted to cooperate with the apertures in the retaining brackets and the support frame means for attaching said support frame means to said retaining brackets of the V-shaped member, for retaining the inward ends of the frame means in abutting relationship with the surfaces of the acute angle of the V-shaped member.

2. An enclosure according to claim 1 and further including an angularly mounted bracket on the inner side of each wedge-shaped structural members for supporting installed equipment thereon.

3. An enclosure according to claim 1 wherein the rigid writing surface has an aperture therein for receiving apparatus and the wedge-shaped members include channels for containing the connecting cables for the apparatus.

* * * * *